United States Patent [19]

Negishi et al.

[11] 4,425,395

[45] Jan. 10, 1984

[54] BASE FABRICS FOR POLYURETHANE-COATED FABRICS, POLYURETHANE-COATED FABRICS AND PROCESSES FOR THEIR PRODUCTION

[75] Inventors: Isamu Negishi, Ina; Kazumi Hunyu, Omiya, both of Japan

[73] Assignee: Fujikura Rubber Works, Ltd., Tokyo, Japan

[21] Appl. No.: 363,477

[22] Filed: Mar. 30, 1982

[30] Foreign Application Priority Data

Apr. 30, 1981 [JP] Japan ..... 56-65564
Apr. 30, 1981 [JP] Japan ..... 56-65565
Apr. 30, 1981 [JP] Japan ..... 56-65566

[51] Int. Cl.[3] ..... B32B 3/00

[52] U.S. Cl. ..... 428/196; 427/245; 427/246; 427/381; 427/389.9; 427/412; 428/195; 428/197; 428/247; 428/253; 428/255; 428/260; 428/264; 428/265; 428/267; 428/423.1; 428/423.3; 428/423.5

[58] Field of Search ..... 428/195, 196, 197, 260, 428/265, 290, 904, 253, 423.1, 423.5, 267, 151, 473, 423.3; 427/245, 246, 381, 389.9, 412

[56] References Cited

U.S. PATENT DOCUMENTS 3,922,418 11/1975 Lauchenauer ..... 428/196
3,939,123 2/1976 Matthews et al. ..... 428/904
4,291,078 9/1981 Lyons ..... 428/151
4,301,053 11/1981 Wolfrey ..... 428/423.1
4,308,184 12/1981 Thoma et al. ..... 428/904

FOREIGN PATENT DOCUMENTS 56-26077 3/1981 Japan ..... 428/198

*Primary Examiner*—James J. Bell

*Attorney, Agent, or Firm*—Koda and Androlia

[57] ABSTRACT

A base fabric for polyurethane-coated fabics which comprises a layer of polyurethane prepolymer under half cross-linked conditions partially formed on at least one surface of the water repellent-unfinished fabric. A process for the production of a base fabric for polyurethane-coated fabrics, which comprises partially coating a solution of polyurethane prepolymer containing a cross-linking agent on at least one surface of the water repellent-unfinished fabric, drying and aging until the polyurethane prepolymer is caused to be under half cross-linked conditions. A polyurethane-coated fabric, which comprises a one-pack polyurethane layer with fine air-permeable pores formed on a water repellent-unfinished base fabric having partially formed on at least one surface thereof a layer of a two-pack polyurethane resin, the fabric and one-pack polyurethane layer being adhered to the layer of the two-pack polyurethane resin as a result of a cross-linking reaction of the polyurethane prepolymer. A process for the production of a polyurethane-coated fabric, which comprises coating, on a base fabric which was prepared by partially coating a solution of polyurethane prepolymer containing a cross-linking agent on at least one surface of a water repellent-unfinished fabric, drying and aging in order to modify the polyurethane prepolymer solution to a half cross-linked polyurethane prepolymer layer, a one-pack polyurethane resin solution having incorporated therein powders capable of dissolving in an eluent, but incapable of dissolving in any solvent of the resin solution, drying, aging in order to adhere and integrate the two-pack polyurethane prepolymer layer, the one-pack polyurethane resin layer and the fabric with each other, and dipping in eluent.

38 Claims, No Drawings

BASE FABRICS FOR POLYURETHANE-COATED FABRICS, POLYURETHANE-COATED FABRICS AND PROCESSES FOR THEIR PRODUCTION

BACKGROUND OF THE INVENTION

1. Field of the Invention

The present invention relates to base fabrics for polyurethane-coated fabrics, the polyurethane-coated fabrics and processes for their production, and, in particular, polyurethane-coated fabrics having a good air-permeability and durability, base fabrics for use in the production of such coated fabrics and processes for their production.

Polyurethane-coated fabrics comprise a base fabric which is composed of woven fabrics, knitted fabrics, nonwovens or the like, the base fabric having formed thereon a microporous layer or polyurethane resins. Fine pores or micropores of the polyurethane resin layer insure that air passes through the coated fabrics.

The polyurethane-coated fabrics have been, in general, widely used in the production of fabric products such as rain wears, sports wears, rucksacks and the like, after their polyurethane resin layer was processed to form therein air-permeable pores and to make these pores to be very fine, and then subjected to water repellent finishing and the like to confer thereto a water repellency in addition to an air-permeability.

2. Prior Art

In the past, it is conventional, in the production of the air-permeable polyurethane-coated fabrics of the above-described type, to partly or completely penetrate a solution of polyurethane resins (one-pack polyurethane resin solution) into the fabrics, and then to elute solvents from the penetrated solution by means of an eluent such as water and the like to solidify the polyurethane resin solution. In the production of the coated fabrics according to the said production process, more large amounts of the polyurethane resin solution must be penetrated into the fabrics, if it is intended to increase a peeling strength between the fabrics and the polyurethane layer. However, this process results in a drawback that an air-permeability of the produced coated fabrics is decreased and, in addition, their hand is damaged, since interstices of the fabrics are completely filled with the polyurethane resin. In contrast, in the case that only a small amount of the polyurethane resin solution is penetrated into the base fabrics, another drawback is induced, namely, the resulting coated fabrics have the worst peeling strength and lack in durability, while they exhibit a good air-permeability and hand.

For the purpose of suitably controlling both of an air-permeability and durability, Japanese Patent Application Laid-Open Gazette No. 56-26077 describes a process for the production of air-permeable coated fabrics which utilizes water repellent-finished fabrics, and which comprises discontinuously applying a layer of acrylic polymers onto the water repellent-finished fabrics to form an adhesive layer, and dipping it in an eluent, while the fabrics are inhibited from being penetrated by a one-pack polyurethane resin solution because of their water repellency. The coated fabrics produced according to this process possess relatively satisfiable properties since their air-permeability and hand are insured as a result of discontinuous formation of the adhesive layer of the acrylic polymers. However, contrarily, they are substantially not usable for the practical purposes due to their lower peeling strength of at most 0.4 kg/cm (It is our experiences that wears or similar products need a peeling strength of an order of at least 0.7 kg/cm). This is because the adhesion between the acrylic polymers and the fabrics and that between the acrylic polymers and the polyurethane layer are not so good as that between polyurethane and the fabrics or between polyurethanes and each other. The fact shows that the formation of the adhesive layer has no significant meaning.

In order to insure an increased adhesion between the fabrics and the adhesive layer or between the polyurethane layer and the adhesive layer, it is preferable to also use polyurethanes as the adhesive layer. However, the use of a polyurethane adhesive layer in place of the above-described adhesive layer of the acrylic polymers results in a disappearance of air-permeability, during application of a one-pack polyurethane resin solution onto the fabrics, since the solvent of the resin solution dissolves the adhesive layer thereby gaps of the partly formed adhesive layer are filled with the dissolved adhesive layer. Therefore, the use of polyurethane as the adhesive layer has not become possible in the past.

SUMMARY OF THE INVENTION

An object of the present invention is to provide base fabrics which are usable in the production of improved polyurethane-coated fabrics, namely, base fabrics which are used in the production of polyurethane-coated fabrics having a good air-permeability, a high peeling strength and an excellent hand, and processes for the production of these base fabrics.

Another object of the present invention is to provide improved polyurethane-coated fabrics, namely, polyurethane-coated fabrics having a good air-permeability, a high peeling strength and an excellent hand, and processes for the production of these coated fabrics.

Still another object of the present invention will be clarified, in sequence, from the following descriptions of the specification.

Accordingly, the present invention provides a base fabric which is characterized in that a layer of polyurethane prepolymer under half cross-linked conditions is partially formed on at least one surface of the water repellent-unfinished fabric. Furthermore, a process for the production of said base fabric according to the present invention is characterized in that the process comprises partially coating a solution of polyurethane prepolymer on at least one surface of the water repellent-unfinished fabric, drying, and aging until said polyurethane prepolymer is caused to be under half cross-linked conditions.

Also, the present invention provides a polyurethane-coated fabric which comprises a one-pack polyurethane layer with fine air-permeable pores formed on a base fabric having partially formed on at least one surface thereof a layer of two-pack polyurethane resin, the fabric and the one-pack polyurethane layer being adhered to and integrated with the layer of two-pack polyurethane resin as a result of a cross-linking reaction of the polyurethane prepolymer.

Further, a process for the production of said polyurethane coated fabric according to the present invention is characterized by coating, on a base fabric which was prepared by partially coating a solution of polyurethane prepolymer on the water repellent-unfinished fabric, drying and aging in order to modify the polyurethane prepolymer solution to a half cross-linked polyurethane prepolymer layer, a one-pack polyurethane resin solution having incorporated therein powders cabable of dissolving in an eluent, but incapable of dissolving in any solvent of the resin solution, drying, aging in order to adhere and integrate the completely cross-linked, two-pack polyurethane layer, the fabric and the one-pack polyurethane layer with each other, and dipping in an eluent in order to form fine air-permeable pores.

According to the base fabrics of the present invention, polyurethane-coated fabrics possessing a very good peeling strength can be produced. This is because, when the coated fabrics are produced, an adhesive layer of polyurethane prepolymer is not adversely affected with a solvent of the one-pack polyurethane resin solution used, since the adhesive layer is under half cross-linked conditions and is partially formed on the fabric, and also because an adhesion between the adhesive layer and the polyurethane layer is attained through their integration with each other as a result of the reaction of the polyurethane prepolymer layer from the half cross-linked conditions to the completely cross-linked conditions.

Furthermore, according to the process of the production of the base fabrics of the present invention, the above-described base fabrics can be easily produced.

According to the polyurethane-coated fabrics of the present invention, there are advantages of a water vapor permeability of more than 2000 g/m$^2$/24 hr and a remarkably high peeling strength of the range of 0.7 to 1.5 kg/cm, since the one-pack polyurethane layer is integrated with the fabric through the two-pack polyurethane resin layer partially formed on the fabric.

Also, according to the process of the production of the coated fabrics of the present invention, there are advantages that the adhesive layer is not affected with a solvent of the one-pack polyurethane resin solution and therefore the coated fabrics can be effectively and easily produced, since the adhesive layer is composed of a half cross-linked polyurethane prepolymer.

Other effects of the present invention will be more clarified through the reference of the following descriptions.

DETAILED DESCRIPTION OF THE INVENTION

The base fabrics of the present invention for use in the production of the coated fabrics comprise a water repellent-unfinished fabric having partially applied thereto a layer of half cross-linked polyurethane prepolymer. The fabric to be used in the present invention is not basically restricted. For example, it may be woven fabrics, knitted fabrics, nonwoven or the like, and may consist of natural or synthetic fibers.

In the specification and appended claims, the phrase "polyurethane prepolymer solution" refers to a mixture of polyol solution and isocyanate solution, and the phrase "polyurethane prepolymer layer" refers to a layer in which the polyurethane prepolymer solution has not yet been completely changed to a polyurethane resin layer. Further, "two-pack polurethane resin layer" used herein, refers to a polyurethane resin layer in which the polyurethane prepolymer solution has been completely cross-linked.

As described above, the polyurethane prepolymer solution contains as its main component an isocyanate solution and a polyol solution, and it also contains additives such as cross-linking agents, catalysts, solvents and the like. The polyurethane prepolymer solution is not basically restricted in the practice of the present invention. For example, an isocyanate component of the polyurethane prepolymer solution, which may be used in the present invention, includes one or more compounds selected from the group consisting of diphenylmethane-4, 4'-diisocyanate, diphenyldimethylmethane-4, 4'-diisocyanate, phenylene-1, 4-diisocyanate, 2,2',6,6'-tetramethyldiphenylmethane-4, 4'-diisocyanate, diphenyl-4, 4'diisocyanate, diphenylether-4, 4'-diisocyanate or its alkyl-, alkoxy- or halogen-substituted derivatives, toluylene-2, 4- and -2,6-diisocyanates or their commercially available mixture, 2, 4-diisopropylphenylene-1, 3-diisocyanate, m-xylylenediisocyanate, p-xylylenediisocyanate and $\alpha,\alpha,\alpha',\alpha'$-tetramethyl-p-xylylenediisocyanate. Further, in the practice of the present invention, any desired types of polyester polyols and polyether polyols may be used as a polyol component of the polyurethane prepolymer solution.

The polyurethane prepolymer may be isocyanate-terminated prepolymers or hydroxyl-terminated prepolymers.

Furthermore, examples of the cross-linking agent usable in the present invention include trifunctional or more functional polyisocyanates or hydroxyl compounds, for example, one or more compounds selected from the group consisting of ethylene glycol, propylene glycol, butane-1, 4-diol, hexane-2, 5-diol, 2,2-dimethylpropane-1, 3-diol, hexane-1,6-diol, 2-methylhexane-1,6-diol, 2,2-dimethylhexane-1,3-diol, p-bishydroxymethyl cyclohexane, 3-methylpentane-1, 4-diol, 2,2-diethylpropane-1, 3-diol and the like.

As the catalyst, tertiary amines, organic tin compounds, organic lead compounds and the like may be used.

As the solvent capable of dissolving polyols and isocyanates, methyl ethyl ketone, ethyl acetate, toluol, xylene, dimethylformamide, methyl isobutyl ketone, butyl acetate, acetone or the like may be used alone or in combination.

A layer of the half cross-linked polyurethane prepolymer is partially coated on the fabric. In this connection, it should be understood that the term "partially", if it is used in the specification and appended claims, is intended to mean that the polyurethane prepolymer layer is not uniformly and entirely applied over the whole surface of the fabric. For example, the polyurethane prepolymer layer in the form of dots, nets, lines or the like may be formed on the fabric.

The polyurethane prepolymer layer formed on the fabric is under the half cross-linked conditions. A degree of cross-linking of the polyurethane prepolymer is preferably in the range of from 30 to 70%. When it is less than 30%, the polyurethane prepolymer layer will be adversely effected by the solvent of the one-pack polyurethane resin solution. This means that a partial formation of the adhesive layer on the fabric is useless and not significant. Further, when it exceeds 70%, an adhesion between the polyurethane prepolymer layer and its overcoat layer, namely the one-pack polyurethane resin layer, will be lowered.

We will now proceed to describe processes for the production of the base fabrics according to the present invention, which are used in the production of the polyurethane-coated fabrics.

According to the production process of the present invention, the above-explained, water repellent-unfinished fabric having no water repellency is first partially coated with a polyurethane prepolymer solution.

The coating procedure is not restricted. For example, the polyurethane prepolymer solution may be coated in a dotwise pattern by means of gravure rolls of 70 to 120 meshes.

A coverage of the polyurethane prepolymer solution should preferably be in the range of from 10 to 30 g/m$^2$. The coverage of less than 10 g/m$^2$ will result in weaker adhesion between the polyurethane prepolymer layer and its overcoat layer, namely, the one-pack polyurethane layer, or the fabric. On the other hand, if the coverage exceeds 30 g/m$^2$, an airpermeability of the resulting coated fabrics will be lowered and also their hand and feel will be hardened, since gaps or spaces of the patterns in the form of dots, lines, nets or the like, namely, areas having no coating of the polyurethane prepolymer solution, are filled with the fallen or scattered polyurethane prepolymer solution.

The polyurethane prepolymer solution-coated fabric is then dried. Drying should preferably be carried out at a temperature of 70° to 150° C. for 30 seconds to 15 minutes. The temperature of less than 70° C. will result in an insufficient proceeding of the reaction in the subsequent aging step due to insufficient volatilization and diffusion of the solvent. Further, if the temperature of more than 150° C. is used in the drying step, the reaction in the subsequent aging step will proceed at an unacceptable high speed, and therefore will not result in desirable half cross-linked conditions of the polyurethane prepolymer.

In addition, the drying time of less than 30 seconds will also result in an insufficient proceeding of the reaction in the next aging step since it does not cause a complete volatilization and diffusion of the solvent, while the drying time of more than 15 minutes will not result in desirable cross-linked conditions of the polyurethane prepolymer since it induces an excessively fast cross-linking reaction in the next aging step.

Thereafter, the so dried fabric is aged. The aging in this step is intended to make the polyurethane prepolymer to be under the half cross-linked conditions. Aging should preferably be carried out by leaving the dried fabric to stand at a temperature of from the room temperature to 70° C. for a time within 48 hours. This is because the aging temperature of more than 70° C. will not result in desired half cross-linked conditions of the polyurethane prepolymer due to an excessively fast cross-linking reaction. Also, if the aging time is longer than 48 hours, the worst adhesion between the fabric and the polyurethane prepolymer coated thereon will be caused due to absence of the uncross-linked polyurethane prepolymer solution.

The production of the base fabrics according to the present invention can be attained through a series of the steps described above. The production should preferably be carried out be repeating two or more times said steps exclusive of the aging step. Namely, it is preferred that aging should be carried out after repeated cycles of the coating and drying step. In the repeated cycles of the coating and drying step, a total amount of the coverage of the polyurethane prepolymer solution should preferably be in the range of from 10 to 30 g/m$^2$. Repeating a series of the above-described steps exclusive of the aging step is effective in insuring a more improved air-permeability of the resulting coated fabrics, because a small amount of the polyurethane prepolymer solution can be used per one coating cycle and therefore gaps of the partially or discontinuously coated polyurethane prepolymer solution can be prevented from their filling with the excess polyurethane prepolymer.

The thus produced base fabric of the present invention for use in the production of the polyurethane-coated fabrics is coated with a solution of one-pack polyurethane resin.

Any urethane polymer may be used in the one-pack polyurethane resin solution, in so far as it is those conventionally used in the prior art coated fabrics of the above-described type. For example, the urethane polymer includes polyether urethane polymer and polyester urethane polymer.

Also, one or more of the following compounds may be effectively used as a solvent in the one-pack polyurethane resin solution:dimethylformamide, ethyl acetate, methyl ethyl ketone, acetone, toluol, butyl acetate, methyl isobutyl ketone, xylene and the like.

Powders to be added to the one-pack polyurethane resin solution, which are incapable of dissolving in a solvent of the solution, but capable of dissolving in an eluent, are used to form fine air-permeable pores in a layer of the one-pack polyurethane resin. The powders may be either inorganic or organic substances, so long as they do satisfy the above described requirements. For example, one or more of the following substances may be used as the powders: sodium carbonate, sodium bicarbonate, potassium bicarbonate, sodium chloride, calcium chloride, sodium nitrate, calcium nitrate, sugar, phenol, sulfosalicylic acid and the like.

It is preferred that the powders are added to the one-pack polyurethane resin solution in an amount of 10 to 100 parts by weight per 100 parts by weight of the solution. If the weight of the powders is less than 10 parts by weight, the number of micropores to be formed within the one-pack polyurethane resin layer is remarkably inhibited and therefore an air-permeability of the resin layer is decreased, while if it exceeds over 100 parts by weight, the strenght of the resin layer is damaged as a result of increase of the percentage of the pores in the resin layer.

The procedure for coating the one-pack polyurethane resin solution onto the base fabric is not basically restricted. Such resin solution may be coated by any of the known coating techniques, such a doctor knife coating, roll coating and the like. A coverage of the resin solution should preferably be in the range from 10 to 200 g/m$^2$, since smaller amounts of less than 10 g/m$^2$ may be adversely affect the adhesion of the resin layer and also larger amounts of more than 200 g/m$^2$ may adversely affect the hand and air-permeability of the coated fabrics. The most preferable coverage of the resin solution is in the range from 20 to 150 g/m$^2$.

After the coating of the one-pack polyurethane resin solution on the base fabric has been completed, the resulting polyurethane-coated fabric is dried, and then aged.

Drying of the coated base fabric should preferably be carried out at a temperature of 70° to 150° C. for 30 seconds or more, since lower temperature of less than 70° C. will result in unsatisfactory cross-linking reaction in the subsequent aging step due to insufficient volatilization and diffusion of the solvent, while higher temperature of more than 150° C. will result in a deterioration of the polyurethane resin. Further, if the drying time is shorter than 30 seconds, the reaction in the aging step will not be satisfactorily proceeded.

Aging of the coated and dried fabric should preferably be carried out by leaving it to stand at a temperature of from the room temperature to 150° C. for a time within 72 hours, since the aging temperature exceeding 150° C. causes a deterioration of the polyurethane resin layer. The aging time of longer than 72 hours is economically not preferred, since the cross-linking reaction of the polyurethane prepolymer has been completed in this stage.

The base fabric having a polyurethane layer which was dried to substantially evaporate the solvent therefrom and harden the layer may be optionally subjected to a crumpling or rubbing process.

The crumpling process acts to:

(1) partially separate the powders from the polyurethane resin layer to ease the elution of the powders from the resin layer, (2) loosen and soften crossover points of the base fabric and also polyurethane resins penetrated into the base fabric, (3) make cracks in the polyurethane resin layer, and (4) destroy thin layer formed between the adhesive layers, and therefore is effective in further improving an air-permeability and hand of the coated fabric.

Through the application of the crumpling process to the coated base fabric, a remarkable loss of the air-permeability and hand of the coated fabric can be prevented, even if larger amounts of polyurethane resin solution is undesirably penetrated into the base fabric, and therefore air-permeable polyurethane-coated fabrics having excellent peeling straight, permeability and hand can be produced.

The procedure for effecting the crumpling process is not restricted in the present invention. For example, any of the known techniques which are conventionally used to achieve crumpling of the woven fabrics and synthetic rubbers, such a hand crumpling, mechanical crumpling and the like may be utilized.

According to the present invention, an additional or second one-pack polyurethane resin solution which composition is identical to or slightly or moderately different from that of the previously coated first one-pack polyurethane resin solution may be also coated on the first one-pack polyurethane resin layer. If this additional coating step is included in the production process of the present invention, it is preferred that the first resin solution is coated at a coverage of 10 to 80 g/m$^2$, and after drying (and, if necessary, after aging) the second resin solution is coated at a coverage of 150 to 400 g/m$^2$. This is because if the first one-pack polyurethane resin solution is coated at a coverage of less than 10 g/m$^2$, an adhesion of the coated layer is deteriorated, while if it is coated at a coverage of more than 80 g/m$^2$, a hand and feel of the coated fabric is damaged. Another reason of preferring the above coverage resides in that if the second one-pack polyurethane resin solution is coated at a coverage of less than 150 g/m$^2$, only an unsatisfactory strength can be achieved in the coated second resin layer, while if it is coated at a coverage of more than 400 g/m$^2$, an air-permeability of the coated layer is damaged.

Thus, a remarkable increase of the hand of the coated fabric can be achieved with the use of the second one-pack polyurethane resin layer described above.

Thereafter, the polyurethane-coated fabric is immersed in an eluent. Usable eluent includes water or one or more alcohols such as methanol, ethanol and the like.

As a result of immersion of the polyurethane fabric, the powders incorporated into the one-pack polyurethane resin solution are eluted together with the solvent of its solution from the coated polyurethane layer, and therefore the polyurethane layer having micropores are formed.

In case of using second polyurethane layer, the first and second polyurethane layers are integrated through the action of the solvent.

Thereafter, according to the present invention, the polyurethane-coated fabric may be optionally hot-air dried at a temperature of 100° to 140° C. to completely remove the eluent, and may be further coated with a water repellent in coat amount of 40 to 50 g/m$^2$ to increase its water proofness. For example, fluorine water repellents, silicone repellents or the like may be effectively used as the water repellent.

Further, subsequent to the above-described processing, the polyurethane-coated fabric may be optionally baked at a temperature of about 150° C. for 30 seconds to two minutes.

The thus produced polyurethane-coated fabric according to the present invention comprises a base fabric having applied thereto a one-pack polyurethane resin layer having air-permeable micropores, the base fabric comprising a water repellent-unfinished fabric having partially applied to at least one surface of the same a two-pack polyurethane resin layer, and has a structure in which the one-pack polyurethane layer and the fabric are adhered to the two-pack polyurethane layer through cross-linking reaction of polyurethane prepolymer.

The fabric, polyurethane prepolymer, one-pack polyurethane and the like are described in detail in the preceding paragraphs concerning the base fabrics for use in the production of polyurethane-coated fabrics and processes for their production and processes for the production of polyurethane-coated fabrics.

A peeling strength between the fabric and the polyurethane layer should preferably be in the range from 0.7 to 1.5 kg/cm. Weaker peeling strength is not suitable for the production of wears and the like, since only a less durability can be achieved. Further, the peeling strength exceeding 1.5 kg/cm is also not desirable, since it tends to adversely affect a hand and water vapor permeability of the coated fabric.

A water vapor permeability of the coated fabric should preferably be 2000 g/m$^2$/24 hr or more. This is because the water vapor permeability of less than 2000 g/m$^2$/24 hr results in an insufficient air-permeability of the coated fabric.

The following examples are provided to further illustrate the present invention. However, it should be understood that these examples do not restrict the scope of the invention.

EXAMPLE 1

A polyurethane prepolymer solution of the following composition (1) was twice coated on one surface of the Oxford-woven nylon fabric by means of gravure rolls of 100 meshes. A total coverage or coat weight of the polyurethane prepolymer solution was 18 g/m$^2$ (determined as the solution). The coated nylon fabric was dried at:

(A) 80° C. for 10 minutes, (B) 120° C. for three minutes, (C) 150° C. for 30 seconds or (D) 170° C. for 30 seconds (comparative example), and then aged for 48 hours at the room temperature and 80° C., respectively. After aging, a one-pack polyurethane resin solution of the following composition (2) was further coated at a coverage of 250 g/m² (determined as the solution) by a doctor knife coating. The coated fabric was immersed in the water at 15° C. for five minutes immediately after coating to harden the coating, and then washing with water for two hours in the water of the same temperature. The washed fabric was finally dried with hot air at 120° C. Properties of the resulting coated fabric are shown in Table 1.

| Composition (1): | parts by weight |
|---|---|
| Hydroxyl-terminated polyester-type polyurethane prepolymer solution [CRYSVON N-184 commercially available from Dainippon Ink & Chemicals, Inc. (hereinafter refers to DIC)] | 100 |
| Trifunctional polyisocyanate solution (CRYSVON NX commercially available from DIC) | 3 |
| Triarylamine catalyst solution (CRYSVON HM commercially available from DIC) | 3 |
| Solvent (methyl ethyl ketone) | 80 |
| Total | 186 |

| Composition (2): | parts by weight |
|---|---|
| Polyester/diphenylmethane diisocyanate-type polyurethane resin solution (CRYSVON 7667 commercially available from DIC) | 100 |
| Dimethylformamide | 30 |
| Sodium carbonate | 50 |
| Anionic surfactant | 3 |
| Colorant | 3 |
| Total | 186 |

TABLE 1

| | Aged at room temp. for 48 hours | | | | Aged at 80° C. for 48 hours | | | |
|---|---|---|---|---|---|---|---|---|
| | A | B | C | D | A' | B' | C' | D' |
| Air permeability* (sec/50cc) | 350 | 360 | 360 | 350 | 340 | 370 | 350 | 340 |
| Peeling strength** (Kg/cm) | 0.80 | 0.85 | 0.73 | 0.38 | 0.47 | 0.51 | 0.36 | 0.13 |
| Hand*** | ◎ | ◎ | ◎ | ○ | ◎ | ◎ | ◎ | ○ |

Notes:
*Air permeability was determined in accordance with the instructions of JIS P8117.
**Peeling strength was determined in accordance with the instructions of JIS K6328.
***Hand was estimated by the hand feeling test and was graded as follows: ◎ . . . very soft, ○ . . . soft, and Δ . . . relatively hard.

EXAMPLE 2

A polyurethane prepolymer solution of the following composition (3) was twice coated on the Oxford-woven nylon fabric of 210D (deniers) by a gravure coater of 70 meshes, and dried at 110° C. for 40 seconds after each of the coating steps. A total wet coverage or coat weight of the polyurethane prepolymer solution was 22.5 g/m². After aging at 25° C. for 24 hours, a one-pack polyurethane resin solution of the following composition (4) was coated on the polyurethane prepolymer layer previously formed on the hylon fabric by a doctor knife coating, and dried at 120° C. for three minutes. A total wet coverage of the one-pack polyurethane resin solution of the composition (4) was 90 g/m². After aging at 25° C. for 24 hours, the polyurethane-coated, dried and aged fabric was washed with water at 60° C. for one hour. After slightly squeezing of the washed fabric, it was dried at 100° C. for five minutes. For a comparative purpose, a control polyurethane-coated nylon fabric was also prepared without using of a coating of polyurethane prepolymer solution. Properties of the resulting polyurethane-coated nylon fabrics were determined as in Example 1. Results are shown in Table 2.

| Composition (3): | parts by weight |
|---|---|
| Hydroxyl-terminated polyester-type polyurethane prepolymer solution (CRYSVON N-184) | 30 |
| Trimethylolpropane/tolylene diisocyanate (molar ratio of 1:3) adduct | 3.5 |
| Solvent (methyl ethyl ketone) | 130 |
| Total | 163.5 |

| Composition (4): | parts by weight |
|---|---|
| Polyester/diphenylmethane diisocyanate-type polyurethane resin solution (CRYSVON 7667) | 30 |
| Flocked pulp material | 10 |
| Powdered sugar | 60 |
| Dimethylformamide (DMF) | 70 |
| methyl ethyl ketone (MEK) | 50 |
| Total | 220 |

TABLE 2

| No. | 1 | 2 |
|---|---|---|
| Adhesive layer | Coated | Not coated |
| Thickness of the layer (mm) | 0.22 | 0.22 |
| Air permeability (sec/50 cc) | 90 | 70 |
| Peeling strength (kg/cm) | 0.81 | 0.41 |

Determination of the properties was made as in Table 1.

EXAMPLE 3

A polyurethane prepolymer solution of the above-described composition (3) and a one-pack polyurethane resin solution of the above-described composition (4) were coated, in sequence, on the Oxford-woven nylon fabric of 210D, and dried as in Example 1. Further, another one-pack polyurethane resin solution of the following composition (5) was coated at a coverage of 210 g/m² on the polyurethane-coated nylon fabric by a doctor knife coating, immersed in the water/DMF (95/5) for five minutes to harden the coating, and washed with water for one hour in the water at 60° C. After slightly squeezing of the washed fabric, it was dried at 100° C. for five minutes. Results are shown in Table 3.

| Composition (5): | parts by weight |
|---|---|
| Polyester/diphenylmethane diisocyanate-type polyurethane resin solution (CRYSVON 7667) | 30 |
| Flocked pulp material | 10 |
| Powdered sugar | 60 |
| DMF | 100 |
| Total | 200 |

TABLE 3

| | |
|---|---|
| Thickness of the layer (mm) | 0.28 |
| Air permeability (sec/50 cc) | 180 |

TABLE 3-continued

| | |
|---|---|
| Water vapor permeability ($g/m^2/24$ hr) | 2300 or more |
| Peeling strength (kg/cm) | 0.72 |

Determination of the properties was made as in Table 1.

EXAMPLE 4

A polyurethane prepolymer solution of the above-described composition (1) was three times on one surface of the plane woven fabric of Tetoron-cotton blended yarns by means of gravure rolls of 120 meshes. A total coverage or coat weight of the polyurethane prepolymer solution was 21 g/m (determined as the solution). The coated fabric was dried at 120° C. for 24 hours.

Further, a one-pack polyurethane resin solution of the following composition (6) was overcoated thereon at a coverage of (A) 40 g/m or (B) 170 g/m (each determined as the solution), and dried at 100° C. for seven minutes.

The dried fabric was subjected to a hand crumpling process by crumpling it at a speed of ten times/min. for three minutes. For a comparative purpose, the corresponding dried fabrics (A') and (B') each of which was not subjected to the hand crumpling process were also prepared.

Immediately after crumpling (A and B) or drying (A' and B'), the coated fabric was immersed in the water at 20° C. for three minutes to harden the coating, and then washed with warm water at 60° C. for one hour. The washed fabric was dried with hot air at 110° C. Thereafter, the dried fabric was treated with an aqueous solution containing 2% of fluorine water repellent, dried at 120° C. for three minutes, and then thermally treated at 150° C. for 30 seconds. Results are shown in Table 4.

| Composition (6): | parts by weight |
|---|---|
| Polyester/diphenylmethane diisocyanate-type polyurethane resin solution (CRYSVON 7667) | 100 |
| Sodium carbonate | 40 |
| Colorant | 3 |
| Methyl ethyl ketone | 20 |
| Toluene | 20 |
| Total | 183 |

TABLE 4

| | Coverage of polyurethane resin sol. (6) 40 $g/m^2$ | | Coverage of polyurethane resin sol. (6) 170 $g/m^2$ | |
|---|---|---|---|---|
| | Crumpled (A) | Not crumpled (A') | Crumpled (B) | Not crumpled (B') |
| Air permeability (sec/50 cc) | 90 | 380 | 180 | 430 |
| Peeling strength (kg/cm) | 1.07 | 1.14 | 1.16 | 1.21 |
| Hand | ◎ | Δ | ○ | Δ |

Determination of the properties was made as in Table 1.

EXAMPLE 5

A polyurethane prepolymer solution of the above-described composition (1) was three times coated on one surface of the plane woven fabric of Tetoron-cotton blended yarns by means of gravure rolls of 120 meshes. A total coverage or coat weight of the polyurethane prepolymer solution was 21 $g/m^2$ (determined as the solution). The coated fabric was dried at 120° C. for five minutes, and then aged at 40° C. for 24 hours.

Further, a one-pack polyurethane resin solution of the above-described composition (6) was overcoated thereon at a coverage of (A) 40 $g/m^2$ or (B) 170 $g/m^2$ (each determined as the solution), and dried at 100° C. for seven minutes.

The dried fabric was subjected to a hand crumpling process by crumpling it at a speed of ten times per one minute for three minutes. For a comparative purpose, the corresponding dried fabrics (A') and (B') each of which was not subjected to the hand crumpling process were also prepared.

Subsequently, a one-pack polyurethane resin solution of the following composition (7) was coated thereon at a coverage of 180 $g/m^2$ (determined as the solution) by a doctor knife coating, immediately immersed in the water at 20° C. for three minutes to harden the coating, and then washed with warm water at 60° C. for one hour. The washed fabric was dried with hot air at 110° C. Thereafter, the dried fabric was treated with an aqueous solution containing 2% of fluorine water repellent, dried at 120° C. for three minutes, and then thermally treated at 150° C. for 30 seconds. Results are shown in Table 5.

| Composition (7): | parts by weight |
|---|---|
| Polyester/diphenylmethane diisocyanate-type polyurethane resin solution (CRYSVON 7667) | 100 |
| Dimethylformamide | 30 |
| Anionic surfactant | 3 |
| Sodium carbonate | 50 |
| Colorant | 3 |
| Total | 186 |

TABLE 5

| | Coverage of polyurethane resin sol. (6) 40 $g/m^2$ | | Coverage of polyurethane resin sol. (6) 170 $g/m^2$ | |
|---|---|---|---|---|
| | Crumpled (A) | Not crumpled (A') | Crumpled (B) | Not crumpled (B') |
| Air permeability (sec/50 cc) | 54 | 210 | 1.8 | 258 |
| Peeling strength (kg/cm) | 1.07 | 1.14 | 1.10 | 1.20 |
| Hand | ◎ | Δ | ○ | Δ |

Determination of the properties was made as in Table 1.

We claim:

1. A process for the production of base fabric for polyurethane-coated fabrics, which comprises partially coating a solution of polyurethane prepolymer containing a cross-linking agent on at least one surface of a water repellent-unfinished fabric at coverage rate of 10 to 30 $g/m^2$, drying at a temperature between 70° and 150° C. for 30 seconds to 15 minutes and aging at a temperature between room temperature and 70° C. for less than 48 hours until said polyurethane prepolymer is caused to be under half crosslinked conditions.

2. A process for the production of a base fabric for polyurethane-coated fabrics according to claim 1, wherein the fabric is any of woven, nonwoven and knitted fabrics of synthetic or natural fibers.

3. A process for the production of a base fabric for polyurethane-coated fabrics according to claim 1, wherein an isocyanate component of the solution of polyurethane prepolymer is one or more substances selected from the group consisting of diphenylmethane-4,4'-diisocyanate, diphenyldimethylmethane-4,4'-diisocyanate, phenylene-1,4-diisocyanate, 2,2',6,6'-tetramethyldiphenylmethane-4,4'-diisocyanate, diphenyl-4,4'-diisocyanate, diphenylether-4,4'-diisocyanate and their alkyl-, alkoxy- or halogen substituted derivatives, toluylene-2,4-diisocyanate, toluylene-2,6-diisocyanate and their commercially available mixture, 2,4-diisopropylphenylene-1,3-diisocyanate, m-xylylene-diisocyanate, p-xylylene-diisocyanate and $\alpha,\alpha,\alpha',\alpha'$-tetramethyl-p-xylylene-diisocyanate.

4. A process for the production of a base fabric for polyurethane-coated fabrics according to claim 1, wherein a polyol component of the solution of polyurethane prepolymer is one or more compunds selected from the group consisting of polyester polyols and polyether polyols.

5. A process for the production of a base fabric for polyurethane-coated fabrics according to claim 1, wherein the cross-linking agent is one or more compounds selected from the group consisting of trifunctional or more functional polyisocyanates and hydroxyl compounds.

6. A process for the production of a base fabric for polyurethane-coated fabrics according to claim 5, wherein the cross-linking agent is one or more compounds selected from the group consisting of ethylene glycol, propylene glycol, butane-1,4-diol, hexane-2,5-diol, 2,2-dimethylpropane-1,3-diol, hexane-1,6-diol, 2-methylhexane-1,6-diol, 2,2-dimethylhexane-1,3-diol, p-bis-hydroxymethyl-cyclohexane, 3-methyl-pentane-1,4-diol and 2,2-diethyl-propane-1,3-diol.

7. A process for the production of a base fabric for polyurethane-coated fabrics according to claim 1, wherein a coverage of the polyurethane prepolymer solution is in the range of from 10 to 30 g/m.

8. A process for the production of a base fabric for polyurethane-coated fabrics according to claim 1, wherein the drying is carried out at a temperature of 70° to 150° C. for 30 seconds to 15 minutes.

9. A process for the production of a base fabric for polyurethane-coated fabrics according to claim 1, wherein the aging is carried out by leaving the dried fabric to stand at a temperature of from the room temperature to 70° C. for a time within 48 hours.

10. A process for the production of a base fabric for polyurethane-coated fabrics according to claim 1, wherein the coating of the polyurethane prepolymer solution on a fabric and the drying are repeated two or more times.

11. A process for the production for polyurethane-coated fabric, which comprises coating on a base fabric, which base fabric was prepared by drying and aging a solution of polyurethane prepolymer containing a cross-linking agent which was partially coated on at least one surface of a water repellent-unfinished fabric in order to modify the polyurethane prepolymer solution to a half cross-linked polyurethane prepolymer layer, a one-pack polyurethane resin solution having incorporated therein powders capable of dissolving in an eluent and which are incapable of dissolving in any solvent of the resin solution, drying and aging in order to cross-link the polyurethane prepolymer layer into a two-pack polyurethane resin layer and dipping in an eluent in order to form a one-pack polyurethane resin layer with fine air-permeable pores.

12. A process for the production of a polyurethane-coated fabric, according to claim 11, wherein the fabric is any of woven, nonwoven and knitted fabrics of synthetic or natural fibers.

13. A process for the production of a polyurethane-coated fabric according to claim 11, wherein an isocyanate component of the polyurethane prepolymer solution is one or more compounds selected from the group consisting of diphenylmethane-4,4'-diisocyanate, diphnyldimethylmethane-4,4'-diisocyanate, phenylene-1,4-diisocyanate, 2,2',6,6'-tetramethyl-diphenylmethane-4,4'-diisocyanate, diphenyl-4,4'-diisocyanate, diphenylether-4,4'-diisocyanate and their alkyl-, alkoxy- or halogen-substituted derivatives, toluylene-2,4-diisocyanate, toluylene-2,6-diisocyanate and their commercially available mixture, 2,4-diisopropylphenylene-1,3-diisocyanate, m-xylylenediisocyanate, p-xylylene-diisocyanate and $\alpha,\alpha,\alpha',\alpha'$-tetramethyl-p-xylylene-diisocyanate.

14. A process for the production of a polyurethane-coated fabric according to claim 11, wherein a polyol component of the polyurethane prepolymer solution is one or more compounds selected from the group consisting of polyester polyols and polyether polyols.

15. A process for the production of a polyurethane-coated fabric according to claim 11, wherein the cross-linking agent is one or more compounds selected from the group consisting of trifunctional or more functional polyisocyanates and hydroxyl compounds.

16. A process for the production of a polyurethane-coated fabric according to claim 15, wherein the cross-linking agent is one or more compounds selected from the group consisting of ethylene glycol, propylene glycol, butane-1,4-diol, hexane-2,5-diol, 2,2-dimethyl-propane-1,3-diol, hexane-1,6-diol, 2-methyl-hexane-1,6-diol, 2,2-dimethylhexane-1,3-diol, p-bis-hydroxymethylcyclohexane, 3-methyl-pentane-1,4-diol and 2,2-diethyl-propane-1,3-diol.

17. A process for the production of a polyurethane-coated fabric according to claim 11, wherein the powder is one or more compounds selected from the group consisting of sodium carbonate, sodium bicarbonate, sodium chloride, calcium chloride, sodium nitrate, calcium nitrate, sugar, phenol, and sulfosalicylic acid.

18. A process for the production of a polyurethane-coated fabric according to claim 11, wherein the powder is added in an amount of 10 to 100 parts by weight per 100 parts of the one-pack polyurethane resin solution.

19. A process for the production of a polyurethane-coated fabric according to claim 11, wherein a solvent of the one-pack polyurethane resin solution is one or more substances selected from the group consisting of dimethylformamide, ethyl acetate, methyl ethyl ketone, acetone, toluol, butyl acetate, methyl isobutyl ketone and xylene.

20. A process for the production of a polyurethane-coated fabric according to claim 11, wherein a coverage of the polyurethane prepolymer solution on a fabric is in the range of 10 to 30 g/m$^2$.

21. A process for the production of a polyurethane-coated fabric according to claim 11, wherein a coverage of the one-pack polyurethane resin solution on a fabric is in the range of 10 to 200 g/m$^2$.

22. A process for the production of a polyurethane-coated fabric according to claim 11, wherein the drying is carried out at a temperature of 70° to 150° C. for 30 seconds to 15 minutes in order to attain half cross-linked conditions of the polyurethane prepolymer.

23. A process for the production of a polyurethen-coated fabric according to claim 11, wherein the aging is carried out by leaving the dried fabric to stand at a temperature of the room temperature to 70° C. for a time within 48 hours to attain half cross-linked conditions of the polyurethane prepolymer.

24. A process for the production of a polyurethane-coated fabric according to claim 11, wherein the drying after coating of the one-pack polyurethane resin solution is carried out at a temperature of 70° to 150° C. for 30 seconds or more.

25. A process for the production of a polyurethane-coated fabric according to claim 11, wherein the aging after coating of the one-pack polyurethane resin solution is carried out by keeping at a temperature of the room temperature to 150° C. for a time within 72 hours.

26. A process for the production of a polyurethane-coated fabric according to claim 11, wherein the coating of the polyurethane prepolymer solution on a fabric and the drying are carried out in two or more cycles.

27. A process for the production of a polyurethane-coated fabric according to claim 11, wherein the one-pack polyurethane resin solution having incorporated therein powders capable of dissolving in an eluent, but incapable of dissolving in any solvent of the resin solution are coated after adhesion and integration of the two-pack polyurethane resin layer formed by cross-linking the half cross-linked polyurethane prepolymer layer, the one-pack polyurethane resin layer and the fabric.

28. A process for the production of a polyurethane-coated fabric according to claim 27, wherein the powder incorporated into the one-pack polyurethane resin solution which is subsequently coated is one or more substances selected from the group consisting of sodium carbonate, sodium bicarbonate, sodium chloride, calcium chloride, sodium nitrate, calcium nitrate, sugar, phenol and sulfosalicylic acid.

29. A process for the production of a polyurethane-coated fabric according to claim 27, wherein the powder is added to the one-pack polyurethane resin solution subsequently coated, in an amount of 10 to 100 parts by weight per 100 parts by weight of the one-pack polyurethane resin solution.

30. A process for the production of a polyurethane-coated fabric according to claim 27, wherein a solvent of the one-pack polyurethane resin solution is one or more substances selected from the group consisting of dimethylformamide, ethyl acetate, methyl ethyl ketone, acetone, toluol, butyl, acetate, methyl isobutyl ketone and xylene.

31. A process for the production of a polyurethane-coated fabric according to claim 11, wherein the crumpling process is carried out after coating and drying the one-pack polyurethane resin solution.

32. A polyurethane-coated fabric, which comprises a one-pack polyurethane layer with fine air-permeable pores formed on a water repellent-unfinished base fabric having partially formed on at least one surface thereof a layer of a two-pack polyurethane resin, the fabric and the one-pack polyurethane layer being adhered to the layer of the two-pack polyurethane resin as a result of a cross-linking reaction of the polyurethane prepolymer.

33. A polyurethane-coated fabric according to claim 32, wherein the fabric is any of woven, nonwoven and knitted fabrics of synthetic or natural fibers.

34. A polyurethane-coated fabric according to claim 32, wherein an isocyanate component of the layer of the two-pack polyurethane resin is one or more compounds selected from the group consisting of diphenylmethane-4,4'-diisocyanate, diphenyldimethylmethane-4,4'-diisocyanate, phenylene-1,4-diisocyanate, 2,2',6,6'-tetramethyl-diphenylmethane-4,4'-diisocyanate, diphenyl-4,4'-diisocyanate, diphenylether-4,4'-diisocyanate and their alkyl-, alkoxy- and halogen-substituted derivatives, toluylene-2,4-diisocyanate, toluylene-2,6-diisocyanate and their commercially available mixture, 2,4-diisopropylphenylene-1,3-diisocyanate, m-xylylene-diisocyanate, p-xylylene-diisocyanate and $\alpha,\alpha,\alpha',\alpha'$-tetramethyl-p-xylylene-diisocyanate.

35. A polyurethane-coated fabric according to claim 32, wherein a polyol component of the layer of the two-pack polyurethane resin is one or more compounds selected from the group consisting of polyester polyols and polyether polyols.

36. A polyurethane-coated fabric according to claim 32, wherein the layer of the two-pack polyurethane resin is formed on a fabric in the form of dots, nets or lines.

37. A polyurethane-coated fabric according to claim 32, wherein the fabric and the one-pack polyurethane resin layer are adhered to the partially formed layer of the two-pack polyurethane resin by completely cross-linking the polyurethane prepolymer with a degree of cross-linking of 30 to 70%.

38. A polyurethane-coated fabric according to claim 32, wherein a peeling strength is in the range of 0.7 to 1.5 kgf/cm and a water vapor permeability is 2000 $g/m^2/24$ hr or more.

* * * * *